US006557938B1

(12) United States Patent
Long

(10) Patent No.: US 6,557,938 B1
(45) Date of Patent: May 6, 2003

(54) ADJUSTABLE LUMBAR DEVICE

(75) Inventor: Harold Dwayne Long, Sarcoxie, MO (US)

(73) Assignee: L & P Property Management Company, SouthGate, CA (US)

( * ) Notice: Subject to any disclaimer, the term of this patent is extended or adjusted under 35 U.S.C. 154(b) by 264 days.

(21) Appl. No.: 09/664,209

(22) Filed: Sep. 18, 2000

(51) Int. Cl.[7] ..... A47C 7/46

(52) U.S. Cl. ..... 297/284.4; 297/284.1; 297/452.18

(58) Field of Search ..... 297/284.4, 284.1, 297/452.18

(56) References Cited

U.S. PATENT DOCUMENTS

| | | | |
|---|---|---|---|
| 3,810,675 | A | 5/1974 | Ferrara |
| 4,019,777 | A | 4/1977 | Hayashi |
| 4,159,847 | A | 7/1979 | Arai |
| 4,182,533 | A | 1/1980 | Arndt et al. |
| 4,435,014 | A | 3/1984 | Gilardi |
| 4,564,235 | A | 1/1986 | Hatsutta et al. |
| 4,565,406 | A | 1/1986 | Suzuki |
| 4,588,172 | A | 5/1986 | Fourrey et al. |
| 5,007,677 | A | 4/1991 | Ozawa et al. |
| 5,087,098 | A | 2/1992 | Ishisuka |
| 5,215,350 | A | 6/1993 | Kato |
| 5,403,069 | A | 4/1995 | Inara et al. |
| 5,452,868 | A | 9/1995 | Kanigowski |
| 5,466,045 | A | 11/1995 | Akima |
| 5,505,520 | A | 4/1996 | Frusti et al. |
| 5,507,559 | A | 4/1996 | Lance |
| 5,553,919 | A | 9/1996 | Dennis |
| 5,588,703 | A | 12/1996 | Itou |
| 5,651,584 | A | 7/1997 | Chenot et al. |
| 5,806,927 | A | 9/1998 | Schneider |
| 5,823,620 | A | 10/1998 | LeCaz |
| 5,911,477 | A | 6/1999 | Mundell et al. |
| 5,947,558 | A | 9/1999 | Suzuki et al. |
| 5,954,399 | A | 9/1999 | Hong |

FOREIGN PATENT DOCUMENTS

| | | |
|---|---|---|
| EP | 97/04580 | 8/1997 |
| WO | PCT/EP97/04580 | 8/1997 |

*Primary Examiner*—Carl D. Friedman
*Assistant Examiner*—Dennis L. Dorsey
(74) *Attorney, Agent, or Firm*—Thompson Coburn LLP; Grant D. Kang; Dennis JM Donahue, III

(57) ABSTRACT

A lumbar support device, preferably secured in a seat frame, includes a support structure attached between a pair of levers that are rotated by an actuator assembly. In one embodiment, the pair of levers are each formed from a serpentine wire, and each lever wraps around a bar that is secured to the seat frame and wraps around a side of the support structure. The actuator assembly rotates the pair of levers which move the support structure into the lumbar region and pull the support structure in tension.

21 Claims, 3 Drawing Sheets

ADJUSTABLE LUMBAR DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates generally to lumbar support devices and particularly to lumbar support devices that are capable of changing shape, especially curvature in the lumbar region.

2. Description of Related Art

Lumbar support devices have been integrated into seats to change their shape, thereby allowing each occupant to adjust the support provided by the seat The curvature of these devices are traditionally adjustable so that an occupant can operate the device to push the seat forward towards the occupant's spinal column in the lumbar region. It is generally known to change the curvature of a lumbar support device using an actuator assembly that moves a support structure. It is also well known to provide an actuator assembly with an effector that is either manually operated, using a handle or a knob, or power-assisted, using a drive motor and control switches. Increased curvature is usually accomplished by moving the support structure forward into the lumbar region, rotating sections of the support structure into the lumbar region, or bowing the support structure out into the lumbar region. As discussed below, these known devices operate on the general principles of increasing the firmness or stiffness of the support structure and changing the shape of the lumbar support device. Many devices produce a uniform curvature across the lumbar region such that the sides of the support structure curve as much as the center portion of the support structure. However, these devices do not increase the stiffness of the support structures. Similarly, a prior art device that increases the stiffness of the support structure does not produce a uniform curvature across the lumbar region. It would be good to increase the stiffness of the support structure and also provide uniform curvature across the support structure.

Examples of lumbar support devices in which the support structure is moved forward into the lumbar region are found in U.S. Pat. No. 4,159,847 and U.S. Pat. No. 5,452,868. In the first invention, the device is secured to a frame such that the support structure is in tension even in a relaxed position. A handle attached to a pair of levers linked to opposite sides of a grid. By rotating the handle, the pair of levers rotate and the grid is thereby moved forward into the lumbar region. Each lever is linked to the grid through a coil spring that produces the tension across the support structure and provides the support structure with a stiffness. Similarly, U.S. Pat. No. 5,452,868 discloses a lumbar support device that uses a single powered lever that to push a lumbar support panel forward into the lumbar region. Although the levers in these inventions uniformly move the support structure forward, they do not increase the stiffness of the support structure.

Examples of lumbar support devices in which sections of the support structure are rotated into the lumbar region are found in U.S. Pat. No. 4,564,235 and U.S. Pat. No. 5,823,620. In the first invention, a pair of plates are rotated into the lumbar region. The plates are situated laterally across the lumbar region and thereby provide uniform curvature across the support structure. However, the tension across the plates is not increased when the plates are rotated and the stiffness of the plates is not increased. The lumbar support device disclosed in U.S. Pat. No. 5,823,620 uses a bowden cable in the actuator assembly to rotate a pair of levers that respectively rotate a pair of pads into the lumbar region. The pads are situated horizontally and do not provide uniform curvature across the support structure, and the stiffness of each lever and its respective pad is not increased.

Examples of lumbar support devices in which the support structure is bowed out into the lumbar region are found in U.S. Pat. No. 4,588,172 and U.S. Pat. No. 5,651,584. In the first invention, the support structure is formed by a sinusoidal spring attached to a grid and positioned between two discs. The discs are attached to a rod and skewed in opposite directions, and a handle is attached to one end of the rod. By rotating the handle from a relaxed position, the rod rotates and the skewed discs rotate away from each other, thereby pulling the spring tighter and flexing the center portion of the spring into the lumbar region. The sinusoidal spring is bowed forward, increasing the tension in the support structure. Although the increased tension increases the stiffness of the support structure, the spring bows laterally across the lumbar region causing a bulge in the center of the lumbar region and resulting in negligible curvature at each side of the lumbar region. Therefore, the lumbar region of a person sitting in such a seat would not be supported at the sides as with a device that produces a uniform curvature across the lumbar region. For example, U.S. Pat. No. 5,651,584 bows a support structure such that a uniform curvature is produced across the lumbar region.

Typically, many lumbar support devices use levers in the actuator assemblies. For the lumbar support devices that use levers, the support structures and actuator assemblies in these devices are generally constructed of materials that are manufactured from individual components and attached by hardware, such as rivets, screws, wire-ties, welds and bolts. Therefore, the designs of these devices require manual assembly operations, including the manual attachment of coil springs and sub-assemblies requiring rivets or welds, and are not well suited for a simplified assembly process.

BRIEF SUMMARY OF THE INVENTION

It is in view of the above problems that the present invention was developed. The invention is a lumbar support device, preferably for use in a seat frame, having a support structure attached between a pair of levers that are rotated by an actuator assembly. In one embodiment, the support structure is formed by a grid having multiple flexible wires securely wrapped around a pair of border wires at opposing sides of the support structure. The support structure has an integral spring formed by a sinusoidal pattern of the multiple flexible wires. Each of the pair of levers is formed from a serpentine wire that wraps around a bar that is secured to the seat and wraps around one of the border wires. The actuator assembly uses a hook and a hooked rod to link the pair of levers, and a bowden cable connects an effector with the hook and the hooked rod. The effector pulls on the bowden cable causing the hook and hooked rod to pull on the pair of levers and resulting in the rotation of the levers. In response, the levers move the grid into the lumbar region, thereby producing uniform curvature across the support structure, and pull the grid in tension, thereby increasing the support structure's stiffness.

In another embodiment, the support structure has a pair of coil springs attached between the pair of levers. The pair of levers are secured to the seat frame. As in the first embodiment, the actuator assembly uses a hook and a hooked rod to link the pair of levers, and a bowden cable connects an effector with the hook and the hooked rod. The effector pulls on the bowden cable causing the hook and hooked rod to pull on the pair of levers and resulting in the rotation of the levers. In response, the levers move the support structure into the lumbar region, thereby producing uniform curvature across the support structure, and pull the support structure in tension, thereby increasing the stiffness of the support structure.

Therefore, it is an object of this invention to provide a lumbar support device capable of increasing the stiffness of the support structure and producing uniform curvature across the support structure.

It is another object of the present invention to provide a lumbar support device capable of producing uniform curvature movement with a lever and support structure that uses fewer parts and hardware than the related art.

It is yet another object of the present invention to provide a process for increasing the stiffness and curvature of a lumbar support device.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE INVENTION

Figure 1:
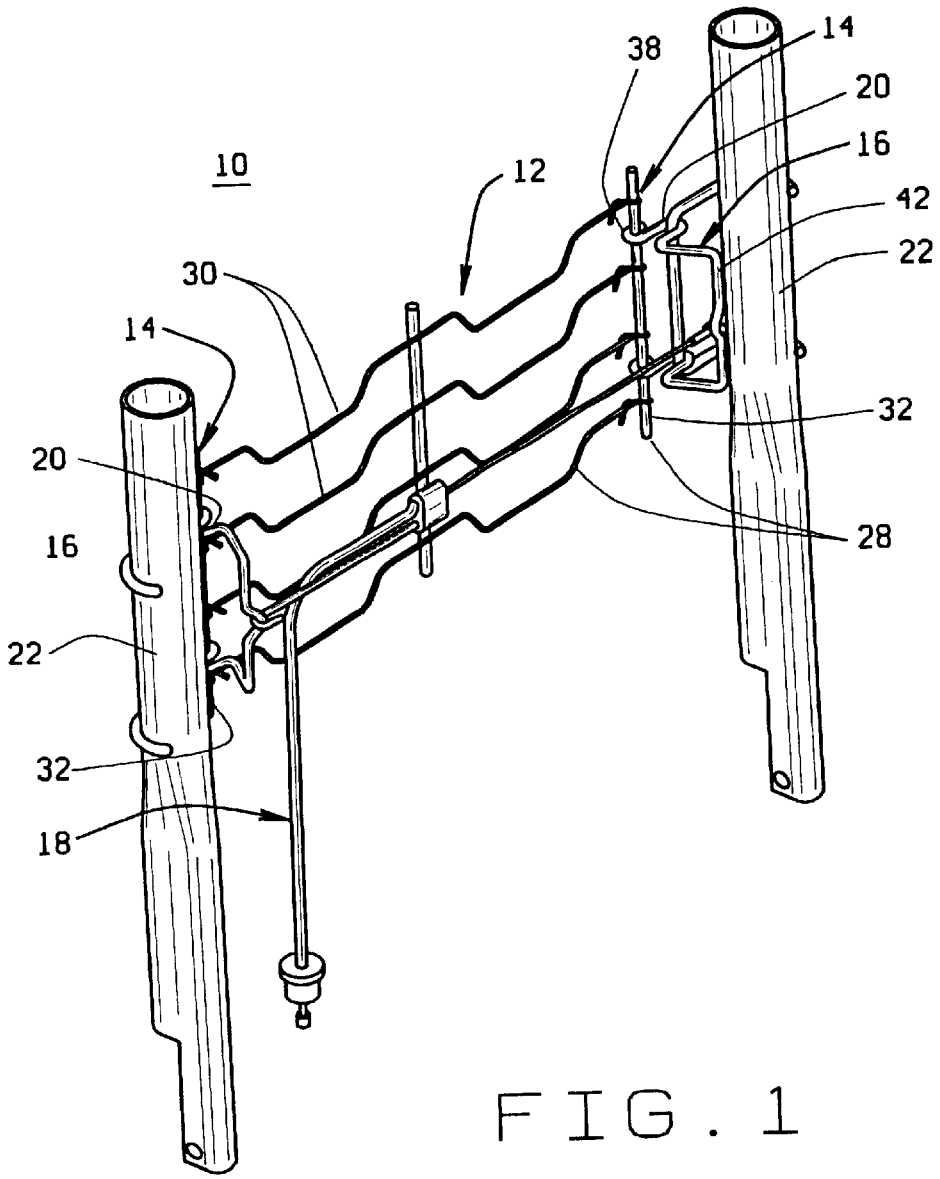
FIG. 1 illustrates a perspective view of a lumbar support device in a frame according to one embodiment of the present invention.
Figure 2:
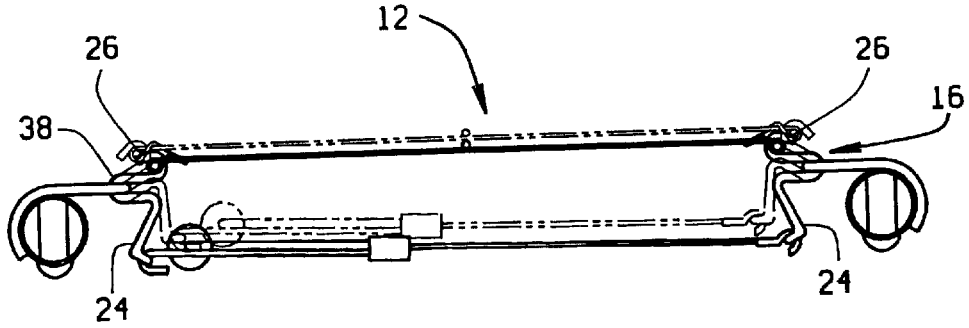
FIG. 2 illustrates a top plan view of the lumbar support device in FIG. 1 in a relaxed position with an alternate actuated position superimposed with a broken line.
Figure 3:
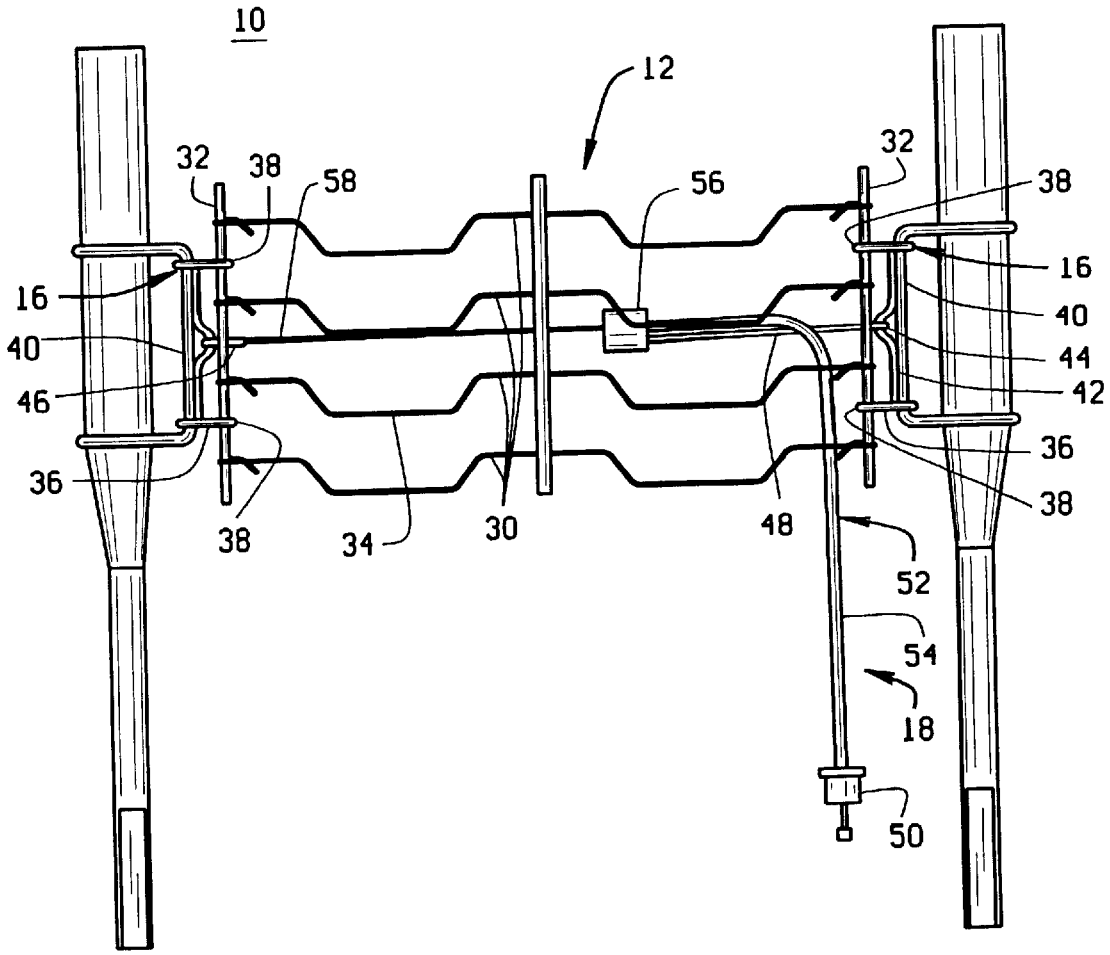
FIG. 3 illustrates a front elevation view of the lumbar support device in FIG. 1.

Referring to the accompanying drawings in which like reference numbers indicate like elements, FIGS. 1–3 illustrate one embodiment of a lumbar support device 10 according to the present invention. The lumbar support device 10 has a support structure 12 with opposing sides 14 that are attached between a pair of levers 16. The levers 16 are rotated by an actuator assembly 18 around a pair of fulcrums 20 that are respectively secured to a frame 22.

FIG. 2 particularly illustrates the lumbar support device 10 in a relaxed position and an alternate actuated position shown in broken lines. The actuator assembly 18 moves the levers 16 from a first position 24 that corresponds to the relaxed position to a second position 26 that corresponds with the actuated position. The lumbar support device 10 is secured to the frame 22 such that when a person's lower back (not shown) engages the frame, the support structure 12 corresponds with the person's lumbar region. The levers 16 uniformly move the support structure 12 forward into the lumbar region, from the relaxed position to the actuated position, resulting in uniform curvature across the support structure. Additionally, moving the levers 16 from the first position 24 to the second position 26 increases tension across the support structure 12, thereby stiffening the support structure.

In this first embodiment, the support structure 12 is formed by a grid 28 having multiple flexible wires 30 securely wrapped around a pair of border wires 32 at the opposing sides 14 of the support structure. At least one of the flexible wires 30 is a sinusoidal wire 34, thereby forming an integral spring in the support structure 12. Each lever 16 is preferably formed from a serpentine wire 36. Each serpentine wire 36 has a pair of s-shaped loops 38 that wrap around each respective border wire 32 and a bar 40 that is secured to the frame 22. The s-shaped loops 38 are separated by a u-shaped loop 42 that has a dimple 44. Accordingly, the pair of serpentine wires 36 wrap around the pair of bars 40 attached to the frame 22.

The actuator assembly 18 links the pair of levers 16 with a hook 46 and a hooked rod 48, respectively, latching onto each lever's dimple 44 on opposing sides 14 of the support structure 12. An effector 50 is connected to the hook 46 and the hooked rod 48 through a bowden cable 52. The bowden cable 52 has a sheathed section 54 between the effector 50 and a base 56 of the hooked rod 48, and the bowden cable has an unsheathed section 58 between the base and the hook 46. The effector 50 pulls on the bowden cable 52, causing the hook 46 and hooked rod 48 to pull on the pair of levers 16, thereby rotating the levers. In response, the levers 16 move the grid 28 into the lumbar region, thereby producing uniform curvature across the support structure. The levers 16 also pull the grid 28 in tension, causing the sinusoidal wire 34 to extend and thereby increasing the stiffness of the support structure 12.

Figure 4:
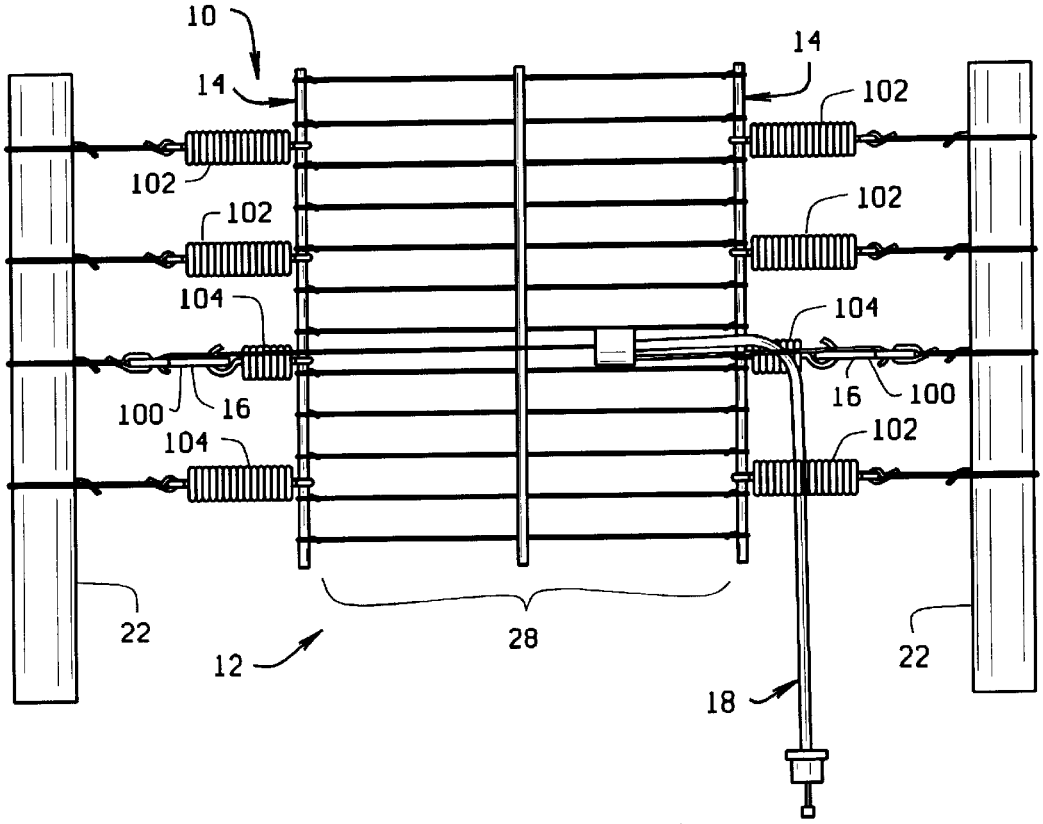
FIG. 4 illustrates a perspective view of a lumbar support devices in a seat frame according to a second embodiment of the present invention.
Figure 5:
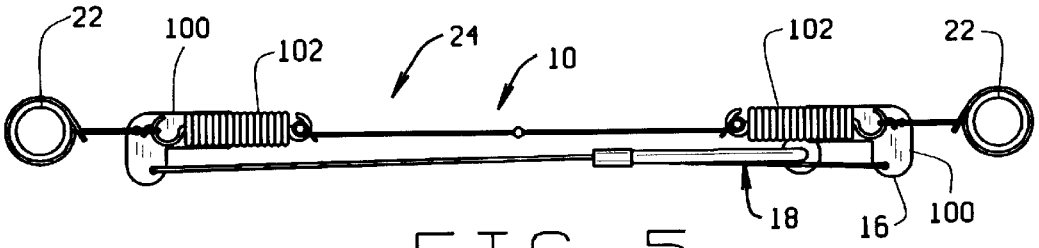
FIG. 5 illustrates a side elevation view of the lumbar support device in FIG. 4 in a relaxed position.
Figure 6:
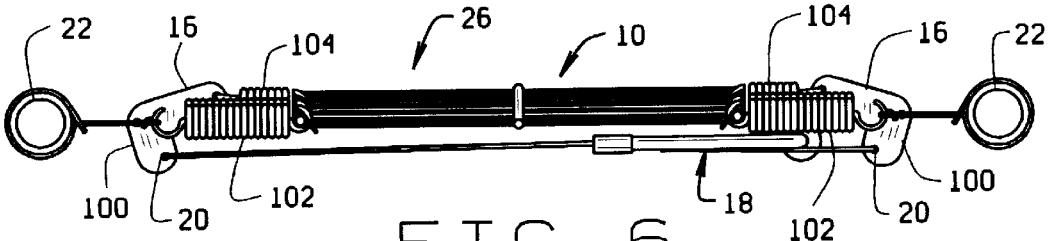
FIG. 6 illustrates a side elevation view of the lumbar support device in FIG. 4 in a curvature position.

A second embodiment of the present invention is illustrated in FIGS. 4–6. As in the first embodiment, the second embodiment of the lumbar support device 10 includes a support structure 12 with opposing sides 14 that are attached between a pair of levers 16. An actuator assembly 18 rotates the levers 16 around a pair of fulcrums 20 that are respectively secured to a frame 22 that is preferably formed in a seat or chair (not shown). A typical pivoting lever 100 is illustrated in the second embodiment, although the serpentine wire 36 from the first embodiment could also be used.

FIGS. 5 and 6 particularly illustrate the lumbar support device 10 in a relaxed position and an alternate actuated position, respectively. As in the first embodiment, the actuator assembly 18 moves the levers 16 from a first position 24 that corresponds to the relaxed position to a second position 26 that corresponds with the actuated position. The levers 16 uniformly move the support structure 12 forward into the lumbar region, from the relaxed position to the actuated position, resulting in uniform curvature across the support structure. Additionally, moving the levers 16 from the first position 24 to the second position 26 increases the tension across the support structure 12, thereby increasing the support structure's stiffness.

In the second embodiment, the lumbar support device 10 is secured to the seat frame 22 through a plurality of springs 102. The support structure has a pair of coil springs 104 at the opposing sides 14 that are attached to the pair of levers 16. As in the first embodiment, the actuator assembly 18 causes the levers 16 to rotate. In response, the levers 16 move the support structure 12 into the lumbar region, thereby producing uniform curvature. The levers 16 also pull the support structure 12 in tension, causing the pair of coil springs 104 to extend and thereby stiffening the support structure 12. Although the support structure 12 in the second embodiment is preferably a grid 28 as in the first embodiment, it is not limited to a grid because the extension of the coil springs 104 increases the stiffness. Therefore, coil springs 104 can vary the stiffness in the support structure 12 even if the portion of the support structure between the coil springs is rigid.

The first embodiment and the second embodiment use the same process to stiffen the support structure 12 and uniformly move the support structure into the lumbar region. The support structure 12 is secured within a frame 22 in the lumbar region. In the relaxed position, the support structure 12 has a particular curvature and stiffness that could be zero or could have some non-zero value. The support structure 12 is moved forward in the lumbar region, thereby increasing the curvature across the support structure compared to the relaxed position. Additionally, the support structure 12 is pulled between the frame 22 in the lumbar region, thereby stiffening the support structure compared to the relaxed position. In both embodiments, pulling the support structure 12 increases the tension across the support structure. In the first embodiment, the increased tension causes the sinusoidal wire 34 to extend and stiffen, acting as an integral spring. In the second embodiment, increased tension causes the coil spring 104 to extend and stiffen.

Securing the support structure 12 to the frame 22 is performed by linking the pair of levers 16 through the actuator assembly 18, attaching the levers to opposing sides 14 of the support structure 12 and respectively securing the levers to the frame at the pair of fulcrums 20 in the lumbar region. Additionally, the support structure 12 is secured to the frame 22 outside the lumbar region. Pulling the pair of levers 16 with the actuator assembly 18 causes the levers to respectively rotate around the pair of fulcrums 20, resulting in pushing the opposing sides 14 of the support structure 12 forward and pulling the opposing sides 14 of the support structure 12 towards the frame 22.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, it will be evident to those skilled in the art that the pair of coil springs 104 taught in the second embodiment could be replaced with other types of springs. Thus, the breadth and scope of the present invention should not be limited by any of the above-described exemplary embodiments, but should be defined only in accordance with the following claims appended hereto and their equivalents.

What is claimed is:

1. A lumbar support device capable of curvature movement in a lumbar region between a relaxed position and an actuated position and capable of being integrated into a frame, comprising:

a support structure having opposing sides;

pair of levers attached to said support structure at said opposing sides, said pair of levers having a pair of fulcrums respectively secured to the frame; and an actuator assembly operatively attached to said pair of levers such that said levers can be moved from a first position corresponding to the relaxed position to a second position corresponding to the actuated position, whereby said levers respectively pull said opposing sides of said support structure toward said frame while moving said support structure forward in the lumbar region.

2. A lumbar support device according to claim 1, wherein said actuator assembly further comprises:

an effector;

a bowden cable having a sheathed section operatively connected to said effector and an unsheathed section;

a hook attached to said unsheathed section of said bowden cable; and a hooked rod having a base attached to said sheathed section of said bowden cable, wherein said hook and said hooked rod are respectively attached to said pair of levers at said opposing sides of said support structure.

3. A lumbar support device according to claim 1, wherein said support structure has a pair of coil springs at said opposing sides and said pair of levers are attached to said support structure through said pair of coil springs.

4. A lumbar support device according to claim 3, wherein said support structure further comprises a grid having a plurality of flexible wires securely wrapped around a pair of border wires at said opposing sides.

5. A lumbar support device according to claim 4, wherein said actuator assembly further comprises:

an effector;

a bowden cable having a sheathed section operatively connected to said effector and an unsheathed section;

a hook attached to said unsheathed section of said bowden cable; and a hooked rod having a base attached to said sheathed section of said bowden cable, wherein said hook and said hooked rod are respectively attached to said pair of levers at said opposing sides of said support structure.

6. A lumbar support device according to claim 1, wherein said support structure further comprises a grid having a plurality of flexible wires securely wrapped around a pair of border wires at said opposing sides.

7. A lumbar support device according to claim 6, wherein said support structure has at least one sinusoidal wire in said plurality of flexible wires forming an integral spring in said support structure.

8. A lumbar support device according to claim 7, wherein said actuator assembly further comprises:

an effector;

a bowden cable having a sheathed section operatively connected to said effector and an unsheathed section;

a hook attached to said unsheathed section of said bowden cable; and a hooked rod having a base attached to said sheathed section of said bowden cable, wherein said hook and said hooked rod are respectively attached to said pair of levers at said opposing sides of said support structure.

9. A lumbar support device according to claim 6, further comprising a pair of bars secured to the frame, and wherein said pair of levers are formed from a pair of serpentine wires wrapped around said pair of bars.

10. A lumbar support device according to claim 9, wherein said pair of serpentine wires each have a pair of s-shaped loops separated by a u-shaped loop, said pair of s-shaped loops for each of said levers respectively wrapping around said border wires and said pair of bars, and wherein said u-shaped loop has a dimple for latching said hook and said hooked rod.

11. A lumbar support device capable of curvature movement in a lumbar region between a relaxed position and an actuated position and capable of being integrated into a frame having a pair of bars, comprising:

a means for supporting the lumbar region;

a pair of levers operatively attached to said support means, each of said pair of levers formed from a serpentine wire having a pair of loops and a u-shaped loop connecting said pair of loops, said pair of loops for each of said pair of levers being wrapped around each of said bars, respectively; and means for moving said levers from a first position corresponding to the relaxed position to a second position corresponding to the actuated position.

12. A lumbar support device according to claim 11, wherein said means for moving said levers is comprised of at least one actuator assembly operatively attached to said pair of levers.

13. A lumbar support device according to claim 11, wherein each of said pair of loops respectively forms a fulcrum for each of said pair of levers.

14. A lumbar support device according to claim 11, wherein said means for supporting the lumbar region is comprised of a support structure having a pair of border wires at opposing sides.

15. A lumbar support device according to claim 14, wherein said pair of loops for each of said pair of levers are s-shaped and are also wrapped around said border wires.

16. A process for increasing curvature and stiffness in a lumbar region from a relaxed position, comprising said steps of:

securing a pair of levers to a frame;

respectively attaching said pair of levers to opposing sides of a support structure in the lumbar region, said support structure having a curvature and a stiffness in the relaxed position; and rotating said pair of levers and thereby moving said support structure forward in the lumbar region while pulling said opposing sides of said support structure towards said frame.

17. A process according to claim 16, wherein the step of rotating said pair of levers increases said curvature of said support structure from the relaxed position while increasing said stiffness of said support structure from the relaxed position and forcing a tension across said support structure.

18. A process according to claim 16, wherein the step of securing said pair of levers to the frame further comprises the steps of:

linking said pair of levers through an actuator assembly; and securing said pair of levers to said frame through a pair of fulcrums.

19. A process according to claim 18, wherein the step ofrotating said pair of levers further comprises the steps of:

pulling said pair of levers with said actuator assembly;

rotating said pair of levers around said pair of fulcrums; and pushing said opposing sides of said support structure forward with said pair of levers.

20. A process according to claim 19, wherein the step of rotating said pair of levers further comprises the steps of:

pulling said pair of levers with said actuator assembly;

rotating said pair of levers around said pair of fulcrums; and pulling said opposing sides of said support structure respectively towards said frame with said pair of levers.

21. A lumbar support device capable of curvature movement in a lumbar region between a relaxed position and an actuated position and capable of being integrated into a frame, comprising:

a support structure having opposing sides;

a pair of levers attached to said support structure at said opposing sides, said pair of levers having a pair of fulcrums respectively secured to the frame; and an actuator assembly operatively attached to said pair of levers such that said levers can be moved from a first position corresponding to the relaxed position to a second position corresponding to the actuated position, thereby stiffening said support structure between said levers and uniformly moving said support structure forward in the lumbar region.

* * * * *